United States Patent [19]

Dahlke

[11] 4,422,173

[45] Dec. 20, 1983

[54] ELECTRODE COLUMN SNUBBER FOR ELECTRIC ARC FURNACE ELECTRODES

[75] Inventor: Milton F. Dahlke, Pasadena, Tex.

[73] Assignee: Armco Inc., Middletown, Ohio

[21] Appl. No.: 358,525

[22] Filed: Mar. 15, 1982

[51] Int. Cl.[3] ..... F27D 11/10; H05B 7/10

[52] U.S. Cl. ..... 373/94; 373/98; 373/105

[58] Field of Search ..... 373/94, 98, 99, 105, 373/106; 248/412, 354 S; 254/270, 277, 285, 292; 212/132, 149, 199

[56] References Cited

U.S. PATENT DOCUMENTS

| | | | |
|---|---|---|---|
| 1,317,911 | 10/1919 | Dyrssen | 373/99 |
| 1,532,599 | 4/1925 | Moore . | |
| 1,616,798 | 2/1927 | Greene | 373/98 |
| 1,813,397 | 7/1931 | Greene . | |
| 2,046,085 | 6/1936 | Moore | 373/98 |
| 2,365,521 | 12/1944 | Brooke . | |
| 3,265,360 | 8/1966 | Tax . | |
| 3,282,449 | 11/1966 | Buford . | |
| 3,823,243 | 7/1974 | Vitale et al. | 373/98 |
| 4,234,151 | 11/1980 | John et al. . | |

*Primary Examiner*—Roy N. Envall, Jr.
*Attorney, Agent, or Firm*—Frost & Jacobs

[57] ABSTRACT

A snubber device for preventing the uncontrolled fall of a column supporting an electrode and crosshead structure in an electric arc furnace upon failure of the hoisting mechanism or cable. Clamp plates containing serrated surfaces are positioned on either side of the electrode column and are joined by a number of parallel link arms to form a pantograph-like structure. A linkage is attached to the cable deadend which causes the plates to move in vertical relationship to each other, thereby causing a horizontal displacement of the plates and clamping the column between them to prevent downward movement. The column snubber is provided with a number of flanged rollers which ride on the outer surface of the column to permit rolling movement between the snubber and column. When the clamp plates are clamping the column, the rollers move out of contact with the outer surface. The column snubber automatically adjusts for wear in the electrode column assembly.

21 Claims, 7 Drawing Figures

ELECTRODE COLUMN SNUBBER FOR ELECTRIC ARC FURNACE ELECTRODES

SUMMARY OF THE INVENTION

The present invention is directed generally to the art of electric arc furnaces of the type having one or more electrodes which extend down into the furnace shell and are supported by a crosshead support structure, and more particularly to a device for preventing the electrodes and support structure from falling into the furnace in the event of failure of the electrode raising and lowering mechanism.

A typical electric arc furnace installation includes a furnace vessel for containing the molten metal, and an electrode assembly which can be lowered into the vessel and withdrawn when the molten material is heated to the desired temperature. In many applications, a number of elongated generally cylindrical electrodes are suspended from horizontally extending support arms or crossheads mounted on a vertically extending column which is free to slide up or down, guided by rollers.

A cable extends around a rotatably mounted sheave or pulley at the bottom of the column. The other end of the cable is attached to the winding drum associated with a motor driven hoist so that the entire electrode assembly attached to the top of the column may be raised or lowered as desired under control of an operator.

As a result of the harsh environment in which this lifting mechanism operates, occasionally the hoist cable will separate or break, permitting the entire electrode assembly to fall without warning into the furnace vessel. Not only can the electrode structure be seriously damaged, but nearby workers may be injured by molten metal splattered from within the vessel.

The present invention is directed to a snubber mechanism which keeps the electrode structure from falling in the event the cable breaks.

In a preferred embodiment, the snubber structure is rigidly attached next to the electrode support column. A pair of clamp plates is disposed on opposite sides of the column, the inner surface of the plates being serrated and normally spaced away from the outside surface of the column to permit normal vertical movement of the column. A plurality of vertically spaced elongated link arms are disposed on opposite sides of the column and extend in parallel relationship between the plates. The ends of these links are pivotally secured to the adjacent plates to form a pantograph-like structure.

A compression spring operates to urge the plates apart when there is tension in the hoist cable. This is accomplished by attaching one end of the cable to a camming assembly which holds the plates apart and at the same time compresses the spring.

However, in the event that tension is released from the cable, such as might occur if the cable breaks, the camming assembly permits the plates to become vertically displaced with respect to each other. Since the plates are joined by the connecting link arms, a change in vertical spacing of the plates also creates a change in the horizontal spacing, thereby forcing the serrated surfaces of the plates against the adjacent outer surfaces of the column. The plates thus snub or grab the column, preventing the electrode assembly from falling.

Further features of the invention will become apparent from the detailed description which follows.

DETAILED DESCRIPTION

Figure 1:
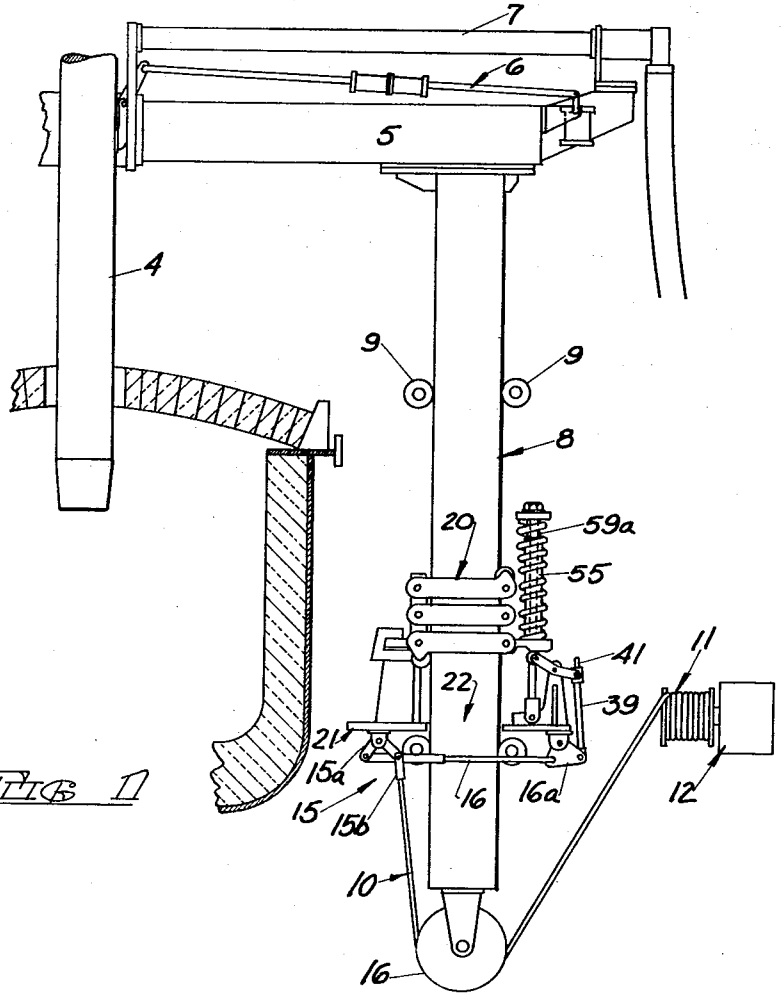
FIG. 1 is a fragmentary partially schematic side elevation view of a typical electric arc furnace support structure employing the column snubber of the present invention.
Figure 2:
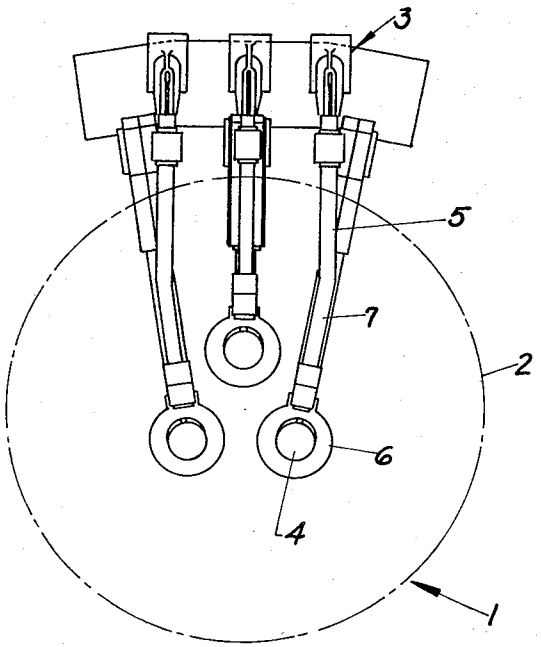
FIG. 2 is a partially schematic top plan view of the typical furnace installation of FIG. 1 having multiple electrode assemblies.

A typical electric arc furnace installation is illustrated in FIG. 1 generally at 1, and includes a cylindrical furnace vessel shown schematically at 2 and three electrode assemblies, one of which is shown at 3. Each electrode assembly includes a vertically extending tubular electrode 4 supported at one end of a horizontally extending support arm or crosshead 5 by means of a spring clamp mechanism 6. As illustrated in FIG. 2, a typical furnace installation 1 may include a plurality of such electrode assemblies 3, operable independently of each other. For purposes of the present description, it will be understood that the construction and operation of the electrode assemblies are identical. The assembly also includes the usual electrical conductor 7 as is well understood in the art. In general, the approximate weight of a typical electrode assembly may be as much as 38,000 pounds.

The electrode assembly is rigidly supported a rigid vertically extending fixed column or mast 8 of generally square or rectangular cross section (see FIG. 7), and is free to move vertically under guidance of guide rollers 9 positioned at vertically spaced locations on either side of column 8. It will be understood that rollers 9 are rotatably mounted in turn to a support structure, not shown.

Column 8 is raised or lowered by means of a hoist cable 10, one end of which is affixed to a hoist drum 11 which is operated by an electric motor or the like 12. Cable 10 extends downwardly around a sheave 16 rotatably mounted to the lower end of column 8. The cable then extends upwardly to a point of attachment 15 associated with the snubber mounting structure attached to the column, as will be described in more detail hereinafter. It will thus be observed that column 8 and the attached structure may be raised or lowered by means of winch 11. Furthermore, in the event that cable 10 should break, column 8 will be unsupported which will permit the electrode assembly 3 to fall downwardly.

This uncontrolled downward movement in the event of cable failure is prevented by the column snubber of the present invention, illustrated generally at 20, which generally surrounds column 8 as best shown in FIG. 1.

Snubber 20 is mounted to and extends upwardly from a generally flat mounting plate 21 which is fixedly secured to a fixed mounting structure (not shown) adjacent column 8. Mounting plate 21 contains a square or rectangular central opening 22 dimensioned to easily pass column 8 as it is raised or lowered.

A first web-like support member 23 extends vertically upwardly from the upper surface of mounting plate 21 and is oriented substantially perpendicularly to one surface of column 8. This support member 23 includes a transversely extending strengthening gusset 24. The upper end of support member 23 terminates in a plate bearing a U-shaped clamp 25. Clamp 25 engages the outwardly extending lower leg-like flange 26*a* of vertically extending plate-like clamp block 26. It will be observed that clamp block 26 has a relatively smooth interior face 27 which extends parallel to and is spaced slightly from the adjacent planar side surface of column 8. A neoprene block 17 supports clamp block 26 in order to absorb mechanical shock when the column snubber assembly catches the falling column.

Figure 7:
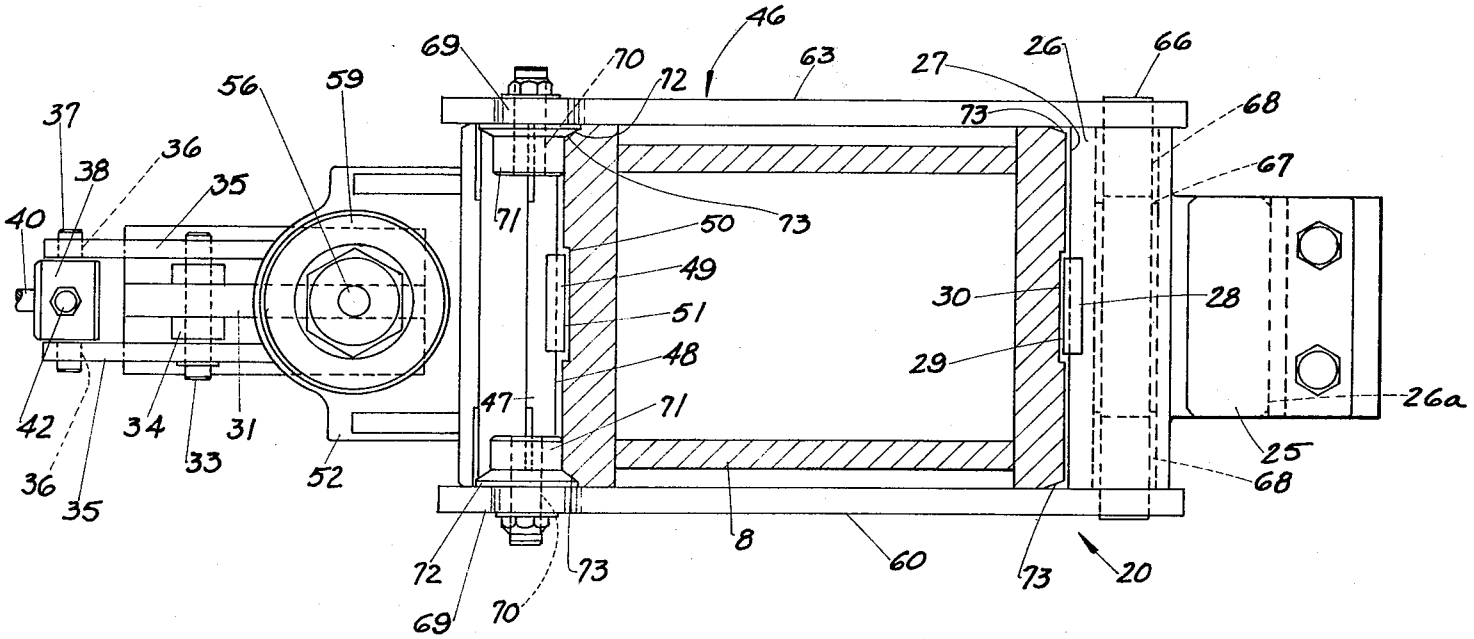
FIG. 7 is an enlarged top plan view of the column snubber of the present invention in the unactivated position.

The central portion of inner surface 27 of clamp block 26 is furnished with an insert 28 having a serrated inner surface 29. Insert 28 may be fixedly attached to clamp block 26 by any convenient means such as screws or the like, not shown. As best shown in FIG. 7, the outer surface of the adjacent face of column 8 is slightly relieved as at 30 so as to accommodate the protruding insert 28. This construction serves to guide the column and attached structure as it moves vertically. It will be further observed that in the event the serrated surface 29 of insert 28 comes in contact with the outer surface of column 8, there will be sufficient frictional engagement to prevent movement of the column.

A second web-like support member 31 extends upwardly from the upper surface of support plate 21 on the opposite side of column 8 from first web-like support member 23. Support member 31 is also provided with a transversely extending strengthening gusset 32. Support member 31 may be rigidly attached to support plate 21 by any suitable means such as welding or the like.

The upper end of support member 31 is provided with a transversely extending generally horizontally disposed shaft 33 which is pivotally secured to the support member by bushing 34.

Each end of shaft 33 is non-rotatably secured to a dog-leg-shaped rocker arm 35. The outermost end of each rocker arm 35 is pivotally secured as at 36 to a transversely extending pivot shaft 37. The central portion of pivot shaft 37 between the inner surfaces of rocker arms 35 is enlarged as at 38 and contains a central radially extending bore 39.

As noted above, the deadend portion 40 of cable 10 is secured to a point of attachment 15 formed by one end of a second dog-leg-shaped rocker arm 15*a* which is pivotally attached to the underside of plate 21. The opposite end of rocker arm 15*b* is pivotally secured to a generally horizontally extending rod-like linkage 16. The opposite end of linkage 16 is pivotally attached to an end of pivot link 16*a*, which is pivotally secured to the underside of plate 21 at a location on the side of column 8 opposite from rocker arm 15*a*. A vertically extending rod-like linkage 39 is pivotally secured to the opposite end of pivot link 16*a*, and is provided with a threaded upper end 41. The upper end of linkage 39 is secured to enlarged portion 38 of pivot shaft 37 by means of a nut 42 threadedly cooperating with threaded portion 41.

The innermost end of each rocker arm 35 terminates in an upwardly directed roller support bracket 43. Each such bracket mounts a transversely extending horizontally disposed shaft 44 to which is rotatably secured a wheel-like camming roller 45. The purpose of these camming rollers will be described in more detail hereinafter.

Column snubber 20 also includes a pantograph-like linkage assembly shown generally at 46. As described hereinabove, assembly 46 includes plate-like clamp block 26 positioned along one of the outer surfaces of column 8. Assembly 46 also includes a similarly configured second plate-like clamp block 47 which is disposed in facing relationship with the opposite face or surface of column 8. Second clamp block 47 includes a generally planar inner surface 48 which extends parallel to and is slightly spaced from the adjacent outer surface of column 8. Inner surface 48 is also provided with a vertically extending slightly protruding insert 49 similar in construction to insert 28 previously described which is configured to slide within the groove-like relieved portion 50 of the column surface. It will be understood that the cooperation between insert 49 and groove 50 assists in guiding the column 8 as it moves vertically. The innermost surface 51 of insert 28 is serrated so as to frictionally engage the adjacent surface of the column when second clamp block 47 is pressed thereagainst to prevent movement of the column as will be described in more detail hereinafter.

The lower portion of second clamp block 47 terminates in an outwardly extending horizontally disposed camming plate 52 positioned in overlying relationship with camming rollers 45. The underside of camming plate 52 is provided with a notch or groove extending inwardly and upwardly toward second clamp block 47 which forms a camming surface 53. Camming rollers 45 are positioned to roll along this camming surface as camming plate 52 pivots as will be described in more detail hereinafter.

The upper surface of camming plate 52 mounts a vertically extending helical compression spring 54 which is held against lateral movement by means of a centrally positioned tube-like projection 55 extending upwardly from the upper surface of camming plate 52. A vertically extending support rod 56 extends vertically through the center of spring 54 and a cooperating bore 57 through camming plate 52 and is pivotally secured to the lower portion of support member 31 as at 58. The upper end of rod 56 threadedly engages a tube 59*a* bearing an upper cap-like portion 59 which bears against the top surface of spring 54. Tube 59*a* is free to slide within tube 55. It will be observed that this arrangement exerts a downward force on the upper surface of the spring, thereby tending to compress it and urge camming plate 52 in a downward direction. In addition, bore 57 is dimensioned to permit free swinging movement of connecting rod 56 therewithin as the camming plate pivots as shown in the alternate operating positions of FIG. 3 and FIG. 4.

Figure 3:
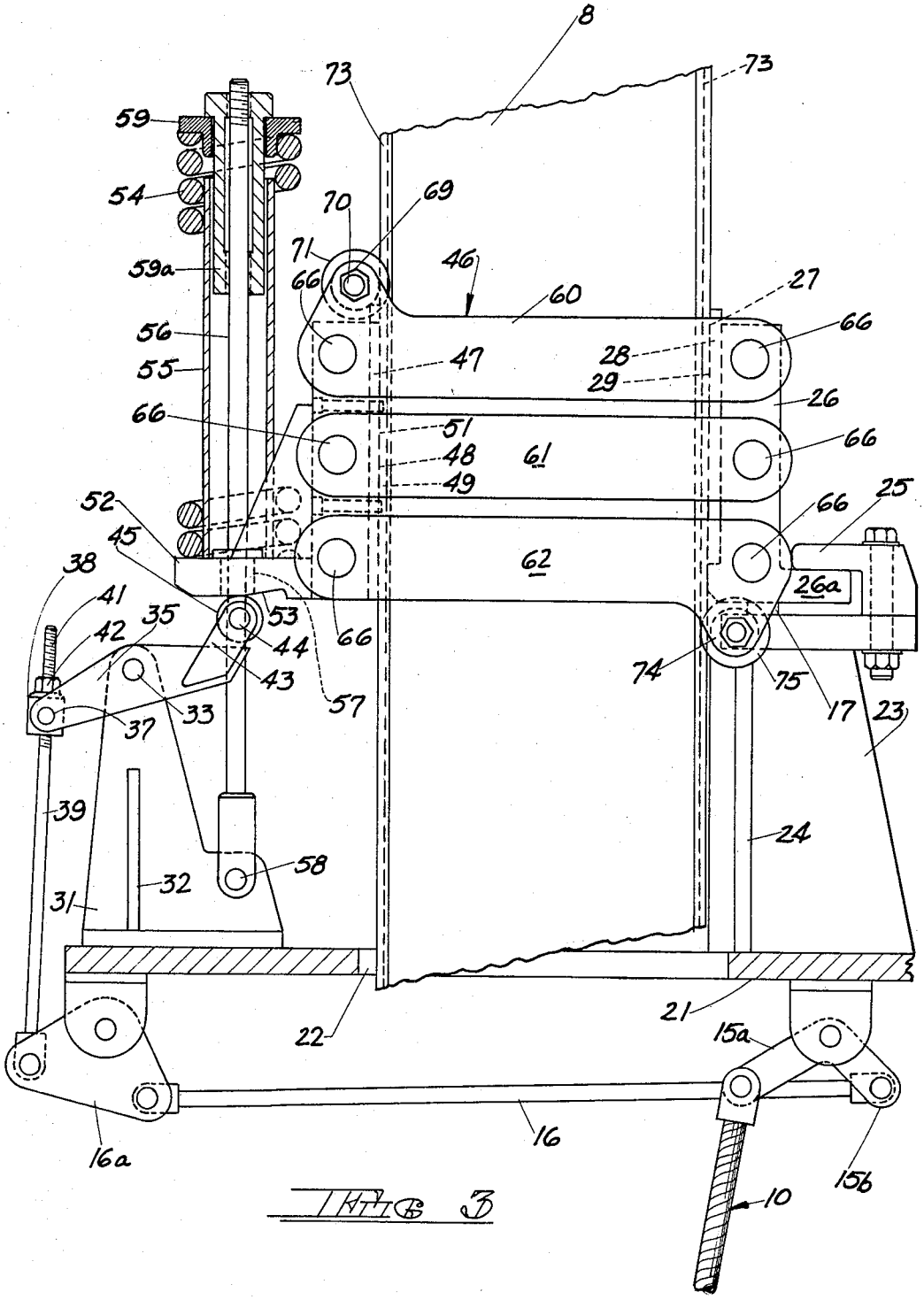
FIG. 3 is an enlarged fragmentary partially cross sectioned side elevation view of the column snubber of the present invention in the normal or unactivated position.

The side edges of first clamp block 26 and second clamp block 47 are pivotally connected by means of a plurality of vertically spaced parallel extending elongated links 60–65 which are spaced from the outer surfaces of column 8 on opposite sides thereof. Although only one set of three link arms 60–62 is illustrated in FIG. 3, it will be understood that the construction of the link arms 63–65 on the opposite side of the column is the same.

Each end of a link arm is non-rotatably secured to a cylindrical shaft 66 which is loosely fitted in a bore 67 extending in a generally horizontal direction through the associated clamp block. A bushing 68 (see FIG. 7) is fitted within either end of bore 67 to provide rotatable support for shaft 66 passing therethrough. It will thus be understood that corresponding ends of horizontally spaced link arms are pinned together. That is, corresponding ends of upper link arms 60 and 63 are pinned together, corresponding ends of middle link arms 61 and 64 are pinned together, and corresponding ends of lower link arms 62 and 65 are pinned together. This configuration creates a pantograph-like structure which insures that first and second clamp blocks 26 and 47 must move in parallel relationship, although the spacing between these members may change. This operation will be described in more detail hereinafter.

The upper portions of the part of upper link arm 60 and 63 nearest spring 54 are provided with an upwardly extending projection 69 which mounts a horizontally disposed cylindrical shaft 70. The inner ends of shafts 70 each rotatably mount a wheel or guide roller 71 having a peripherally extending flange 72 along its outermost edge. Flanged cam or guide rollers 71 are positioned so that their outer surfaces are in rolling contact with the adjacent planar surface of column 8, while flanges 72 are in rolling contact with the chamfered corners 73 of the column. Consequently, guide rollers 71 assist in keeping the snubber guided while the column is raised or lowered.

Similarly, the lowermost portions of the ends of lower link arms 62 and 65 adjacent clamp 25 are provided with downwardly directed projections 74 which rotatably support flanged cam or guide rollers 75 of construction similar to guide rollers 71. Guide rollers 75 also have peripherally extending flanges 76 which abut the chamfered corners 73 of the column, while the outer surface of the roller is positioned in rolling contact with the adjacent vertically extending flat surface of the column. Guide rollers 75 also serve to position and guide the snubber assembly as the column moves past it.

In operation, the electrode assembly 3 and column 8 attached thereto may be raised or lowered by means of cable 10 and motor driven winch 11. During normal operation, there will be sufficient tension in cable 10 to exert a strong downward force on one end of rocker arm 15*a*, exerting a downward force on rod-like linkage 39 through intermediate linkage 16 and pivot link 16*a*. This causes camming rollers 45 to be urged upwardly against the camming surface 53 to thus holding the linkage assembly 46 in the position illustrated in FIG. 3 where link arms 60–65 are substantially horizontal. At the same time, spring 54 is compressed and exerts a holding force against the upper surface of camming plate 52.

In this position, because of the pantograph-like nature of the linkage assembly, first clamp block 26 and second clamp block 47 and their associated serrated surfaced inserts will be spaced in parallel relationship out of contact with the outer surface of the column 8. It will be observed that the column floats or is self-aligning with respect to snubber 20 so as to automatically adjust for wear occurring between the moving and stationary members, such as might occur with wear of the rollers guiding the column.

Figure 4:
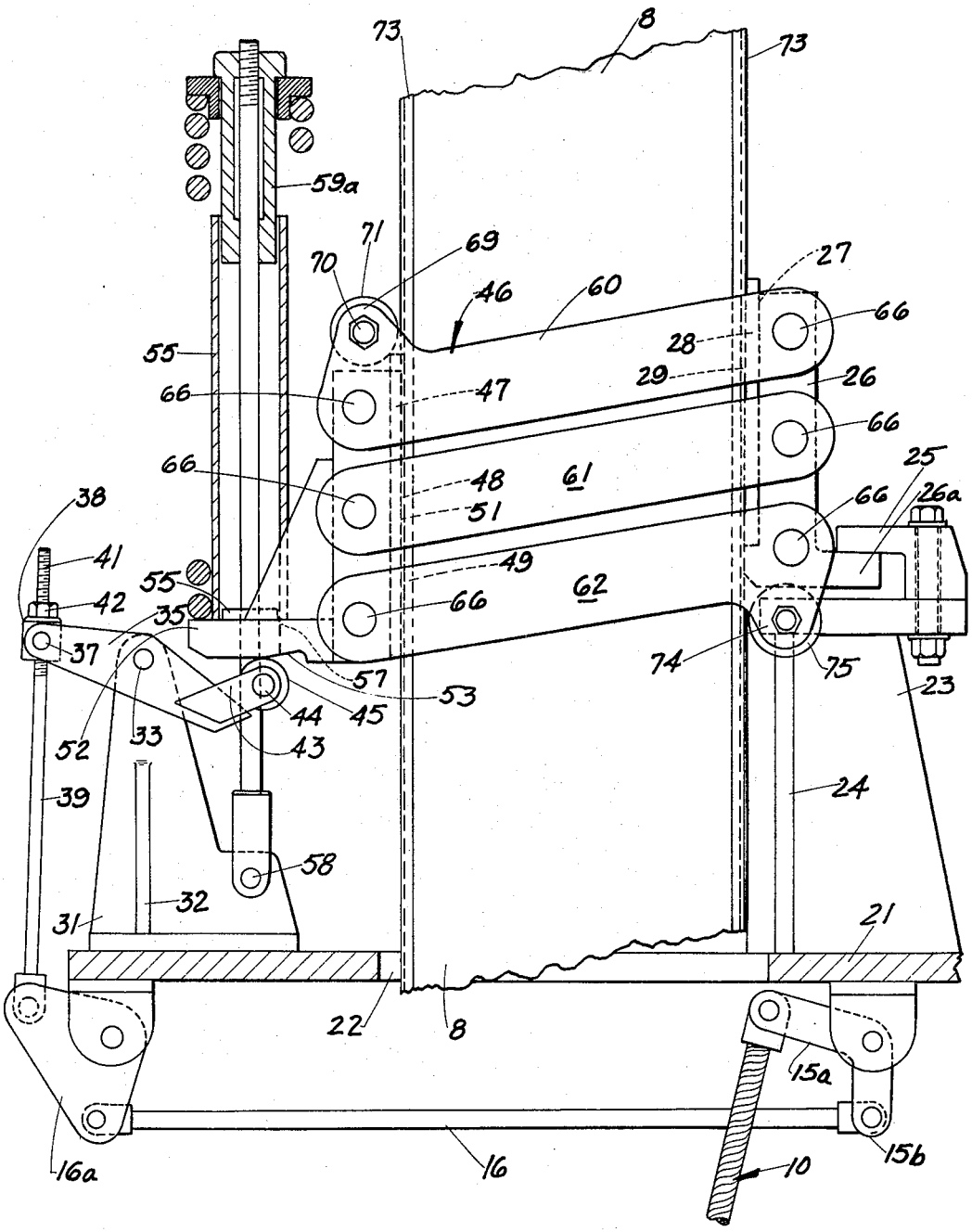
FIG. 4 is an enlarged fragmentary partially cross sectioned side elevation view of the column snubber of the present invention in the activated position.
Figure 5:
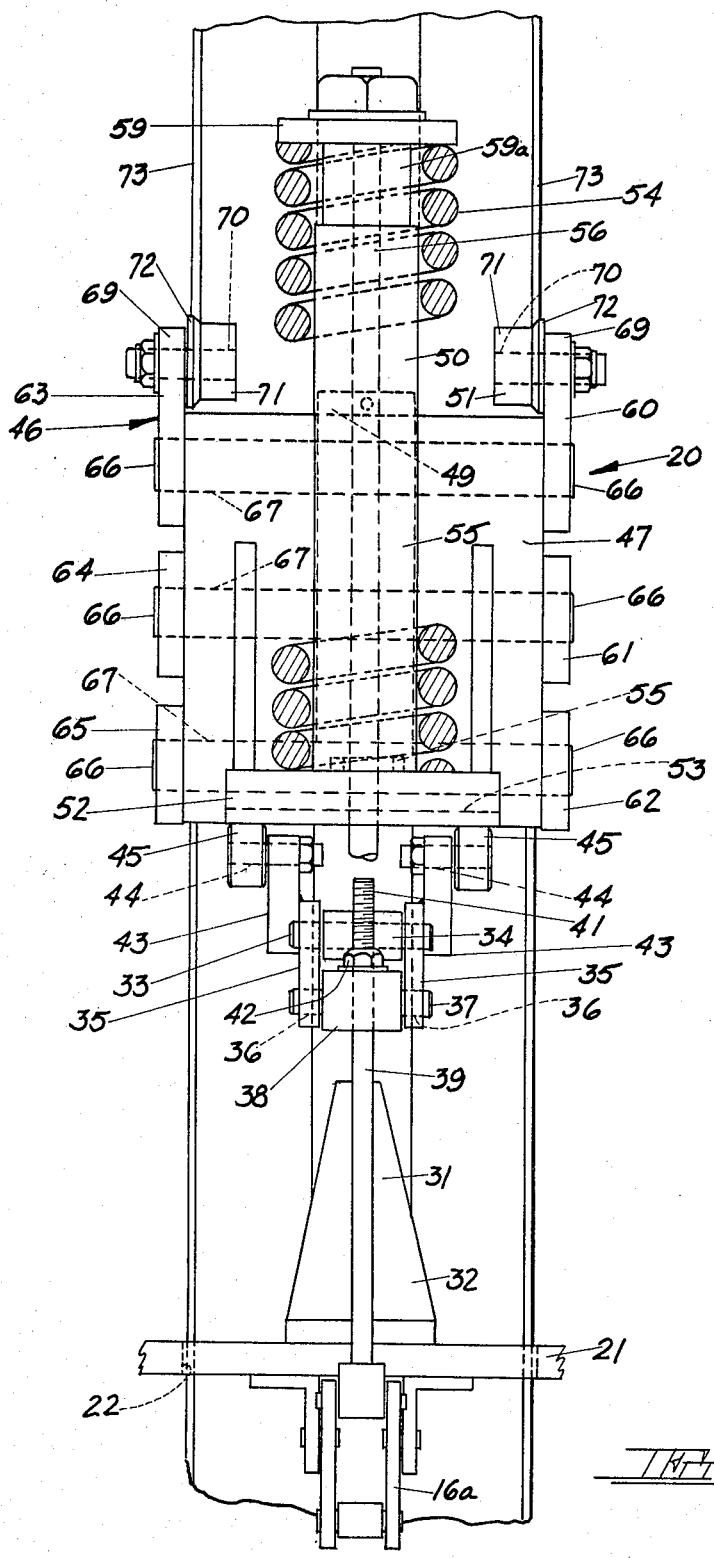
FIG. 5 is an enlarged fragmentary front elevation view of the column snubber of the present invention in the unactivated position.
Figure 6:
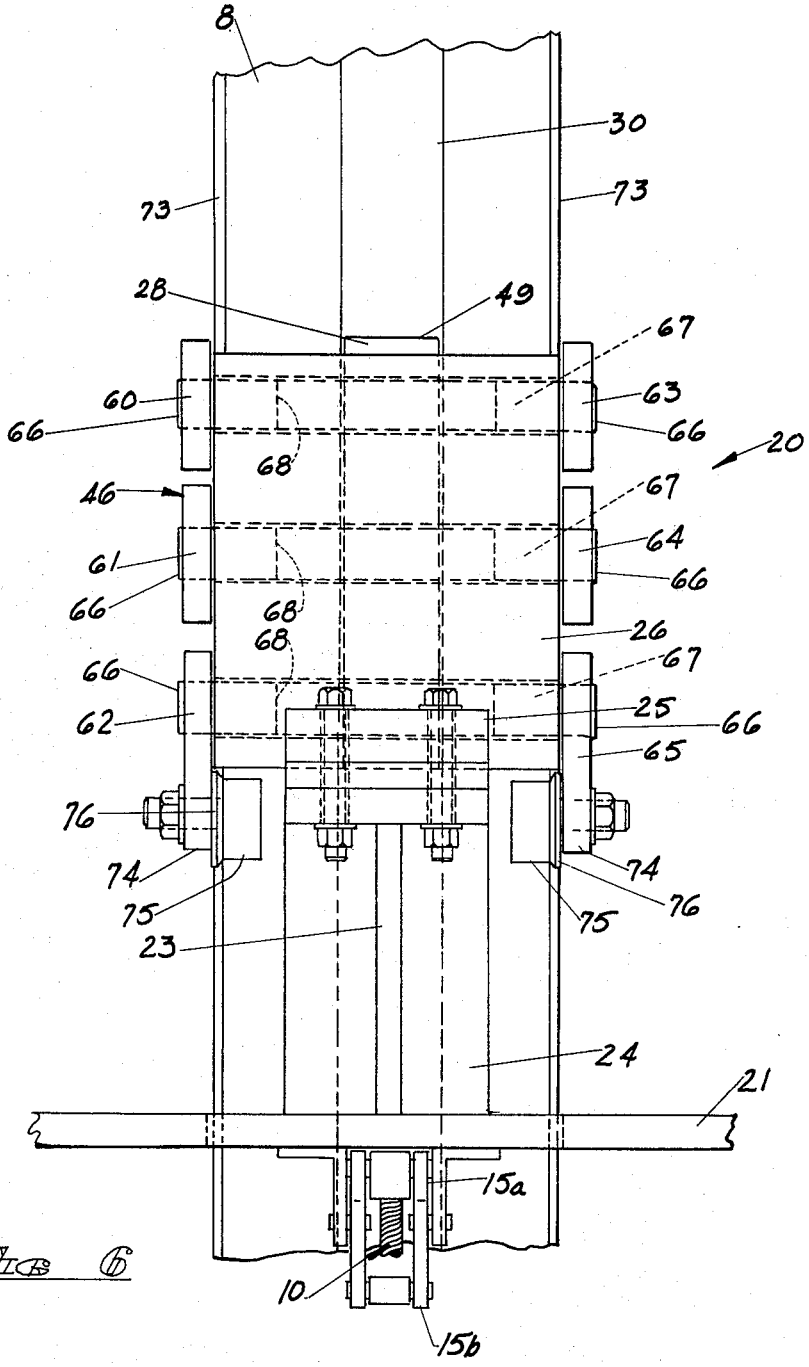
FIG. 6 is an enlarged fragmentary rear elevation view of the column snubber of the present invention in the unactivated position.

In the event that tension is released in cable 10, such as might occur if the cable breaks or if the winding hoist is suddenly released, the force exerted by compressed spring 54 will urge camming plate 52 downwardly to the position illustrated in FIG. 4. It will be observed that as this occurs, connecting rod 57 pivots slightly in a clockwise direction as viewed in FIG. 4 about pivot point 58. As noted, bore 57 is dimensioned to accommodate the movement of rod 56 therewithin.

At the same time, second clamp block 47 which is rigidly connected to camming plate 52 moves downwardly, also to the position shown in FIG. 4. However, since first clamp block 26 is constrained by clamp 25 to move only in the horizontal direction, the pantograph-like linkage assembly 46 forces the two clamp blocks to move together, thereby bringing the serrated surfaces 29 and 51, respectively, into frictionally engaging contact with the adjacent outer surface of column 8. The force exerted by spring 54 is such as to forceably urge the clamp blocks together, thereby catching and holding column 8 to prevent it from falling. In other words, the column snubber mechanism of the present invention consists of two parallel plates each containing a serrated faced insert. These plates are pinned together with three links and when one side drops, the parallel plates move together and catch the falling column. The snubber assembly will remain in this position until tension is restored to cable 10. It will further be observed that when the column snubber is in the second or column engaging position as shown in FIG. 4, rollers 71 and 75 are positioned out of contact with the respective outer surfaces of the column.

It will be understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. In an electric arc furnace construction of the type comprising a furnace vessel having a top opening, an electrode extending vertically through the opening into the vessel, a horizontally extending crosshead supporting at one end the upper end of the electrode, a vertically extending column connected to and supporting the opposite end of the crosshead at its upper end, said column being movable vertically to adjust the electrode height within the furnace vessel, and powered moving means for raising and lowering the column, the improvement in combination therewith comprising electrode column snubber means for catching the electrode column and structure attached thereto to prevent uncontrolled descent thereof in the event of failure of the moving means including:

first and second clamp plates disposed on opposite sides of the column, respectively, each of said plates including means on its inner face for frictionally engaging the adjacent outer surface of the column when pressed thereagainst, said plates being movable between a first position out of contact with the outer surface of the column to permit vertical movement of the column, and a second position wherein said plates are forced against the outer surface of the column to prevent downward movement of the column; and means for shifting said plates to said second position in the event of failure of said powered moving means which would otherwise allow the column to fall in an uncontrolled manner.

2. The apparatus according to claim 1 wherein said powered moving means includes a lifting hoist and a cable having one end attached to the hoist for winding thereon and the deadend of the cable to said shifting means for causing said plates to assume said second position upon 01336/ release of tension in the cable.

3. The apparatus according to claim 2 wherein said shifting means includes linkage means connected to said cable deadend for moving the plates toward each other upon release of tension in the cable.

4. The apparatus according to claim 3 wherein the column engaging surfaces of said plates remain substantially parallel to each other at all times.

5. The apparatus according to claim 4 wherein said shifting means includes means for altering the relative vertical positions of said plates so as to draw them together to clamp the column therebetween.

6. The apparatus according to claim 1 wherein the column engaging surfaces of said plates remain substantially parallel to each other at all times.

7. The apparatus according to claim 6 wherein said plates are pivotally joined by a plurality of spaced link arms to form a pantograph-like structure.

8. The apparatus according to claim 7 wherein said shifting means includes means for altering the relative vertical positions of said plates so as to draw them together to clamp the column therebetween.

9. The apparatus according to claim 8 wherein said second plate is restrained against vertical movement and said first plate is shiftable vertically with respect to said second plate.

10. The apparatus according to claim 9 including means for biasing said first plate to a vertical position corresponding to said second position of said plates upon failure of the powered moving means.

11. The apparatus according to claim 10 wherein said powered moving means includes a lifting hoist and a cable having one end attached to the hoist for winding thereon and the cable deadend connected to the shifting means for causing said shifting motion upon release of tension of the cable.

12. The apparatus according to claim 11 wherein said shifting means comprises a rocker arm, means for connecting one end of said rocker arm to said cable deadend, and means connected to the other end for urging said first plate to said first position against the force of said bias means, said rocker arm being pivotable about a point between its ends.

13. The apparatus according to claim 12 wherein said urging means comprises a plate extending outwardly from said first plate and having a camming surface thereon and at least one camming roller rotatably connected to said other end of the rocker arm and arranged to make rolling contact with said camming surface.

14. The apparatus according to claim 1 including roller means cooperating with the outer surface of the column for rolling movement therealong.

15. The apparatus according to claim 14 wherein said roller means assume a position out of contact with the column when said plates are in the second position.

16. The apparatus according to claim 1 including roller means cooperating with the outer surface of the column for rolling movement therealong, said rollers assuming a position out of contact with the column when said plates are in the second position.

17. The apparatus according to claim 1 wherein said powered moving means comprise a lifting hoist and a cable having one end attached to the hoist for winding thereon, the other end of the cable forming a cable deadend, the column engaging surfaces of said plates being substantially parallel to each other at all times, said plates being pivotally joined by a plurality of vertically spaced generally parallel link arms to form a pantograph-like structure, said plates being shiftable vertically relative to each other so as to draw them together to clamp the column therebetween, said second plate being restrained against vertical movement and said first plate being shiftable in a vertical direction, a flange-like projection extending outwardly from said first plate away from the column, the undersurface of said flange forming a groove-like camming surface, the opposite surface of said projection supporting a helical spring extending generally parallel to said mast, a connecting rod attached at one end to the upper end of said spring and extending therewithin through a cooperating bore in said projection, the opposite end of said connecting rod being pivotally secured to a fixed support member, said fixed support member pivotally mounting a rocker arm having one end secured to the cable deadend and the opposite end rotatably supporting a camming roller in rolling contact with said camming surface, whereby said rocker arm operates to force said roller against the camming surface to compress said spring and maintain said plates in said first position when there is tension in the cable, said spring forcing said projection toward said camming roller such that the plates assume said second position when tension is released in the cable.

18. The apparatus according to claim 17 including a roller secured to one end of each of the uppermost and lowermost link arms, said rollers making rolling contact with the outer surfaces of said column when said plates are in the first position.

19. The apparatus according to claim 18 wherein said rollers are so positioned on said link arms that they assume a position out of contact with the outer surfaces of the column when the plates are in the second position.

20. The apparatus according to claim 19 wherein said column is of generally rectangular shape.

21. The apparatus according to claim 20 including a chamfer extending along each corner of the column, each roller including a peripheral flange positioned to ride on the adjacent chamfer.

* * * * *